US008272106B2

(12) United States Patent
Payne

(10) Patent No.: US 8,272,106 B2
(45) Date of Patent: Sep. 25, 2012

(54) COTTON GINNING APPARATUS

(75) Inventor: Trevor Payne, Nottingham (GB)

(73) Assignee: Templeton International Limited, Hong Kong (CN)

( * ) Notice: Subject to any disclaimer, the term of this patent is extended or adjusted under 35 U.S.C. 154(b) by 214 days.

(21) Appl. No.: 12/742,695

(22) PCT Filed: Nov. 16, 2007

(86) PCT No.: PCT/GB2007/004369

§ 371 (c)(1),
(2), (4) Date: May 13, 2010

(87) PCT Pub. No.: WO2009/063153

PCT Pub. Date: May 22, 2009

(65) Prior Publication Data

US 2010/0269305 A1 Oct. 28, 2010

(51) Int. Cl.
*D01B 1/04* (2006.01)

(52) U.S. Cl. ..... 19/48 R

(58) Field of Classification Search ..... 19/39, 48 R, 19/53

See application file for complete search history.

(56) References Cited

U.S. PATENT DOCUMENTS 2,929,111 A 3/1960 Williams et al.
5,606,776 A * 3/1997 Freund et al. ..... 19/105
6,115,887 A 9/2000 Riter
6,122,803 A 9/2000 Payne
6,317,932 B1 * 11/2001 Staples et al. ..... 19/105
2004/0255429 A1 * 12/2004 Clausen ..... 19/97.5
2010/0269304 A1 * 10/2010 Stover ..... 19/64.5

FOREIGN PATENT DOCUMENTS

GB 1042230 9/1966

OTHER PUBLICATIONS

International Search Report for PCT/GB2007/004369, Oct. 17, 2008, 2 pages.

* cited by examiner

*Primary Examiner* — Shaun R Hurley
(74) *Attorney, Agent, or Firm* — Reising Ethington P.C.

(57) ABSTRACT

A driven conveyor having an upper surface for receiving and transporting seed cotton comprises a plurality of spaced apart slats, each extending transversely relative to the direction of travel. Each slat has a roughened surface to which cotton fiber will adhere. The transverse gaps between the respective slats facilitate severance of seed by a transverse blade that is in contact with the upper surface of the conveyor, while the cotton fiber adheres to the slatted upper surface and is pulled through the pinch point between the blade and the conveyor. An air flow chamber is arranged above the blade so that seed separated from the fiber at the pinch point can be removed. An air suction device is provided downstream of the blade for removal of the fiber from the upper surface. A blade mounting assembly resiliently biases the blade in floating contact with the upper surface of the conveyor.

15 Claims, 9 Drawing Sheets

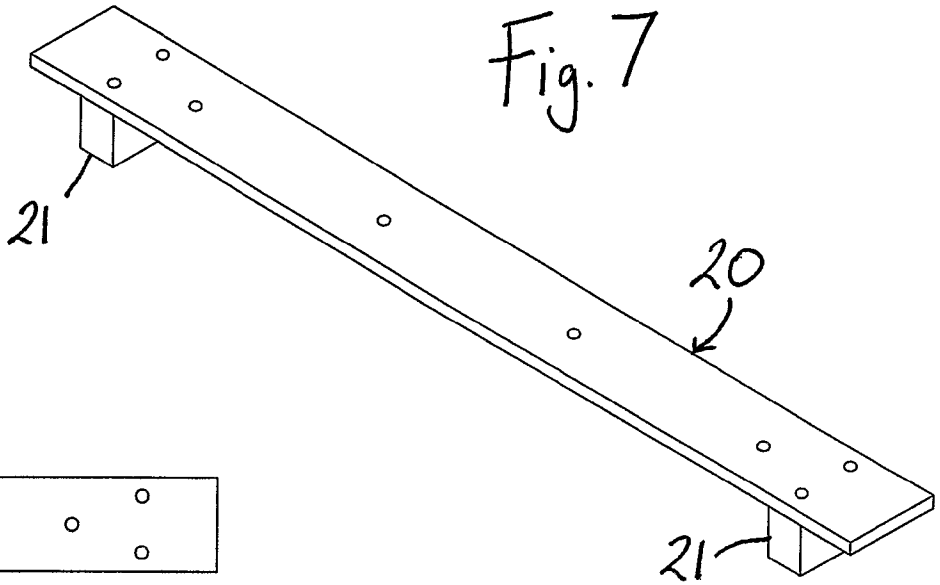
Fig. 7
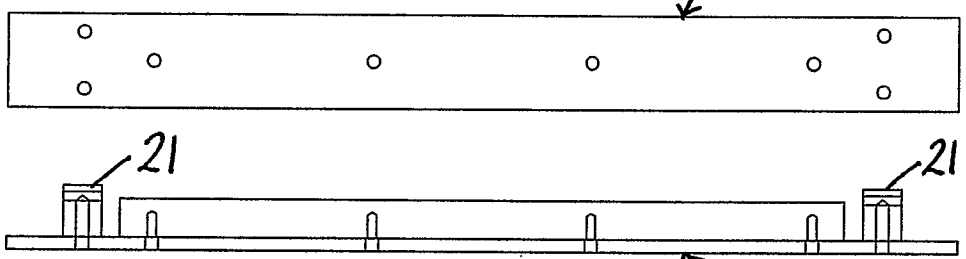
Fig. 8
Fig. 9
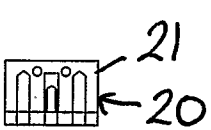
Fig. 10

30
38
34
36
32
B
48
42
46
44
52
54
39
50
40
22
20
16
24
29
26
12

30
38
34
36
48
42
B
32
46
52
39
50
54
40
A
20
22
16
24
29
26
12

COTTON GINNING APPARATUS

This invention relates to an apparatus for ginning cotton, the process of separating cotton lint (i.e., fibre) from seed after harvesting.

Traditionally, two main types of ginning apparatus have been employed, namely roller gins and saw gins. In a roller gin, for example as described in U.S. Pat. No. 4,094,043, (Vandergriff) seed cotton is fed, via a hopper feed assembly, into contact with a roller having a roughened surface layer to which the fibres adhere and then dragged past a fixed blade which is pressed into contact with the roller surface. A reciprocating knife above the fixed blade separates the seed from the fibre. The seed drops through a grid and the fibre is subsequently stripped from the surface of the roller by a rotating bladed stripper.

Compared to a saw gin, a roller gin results in a better quality product as the fibre is well separated from the seed, relatively uncontaminated with broken seeds as is the case in a saw gin, and the fibre itself tends not to be torn and damaged, as is the case with a saw gin. However, the speed is far lower than with a saw gin owing to the limited size of a roller and the intermittent operation of the cutting knife. Roller gins are typically used for higher grade sea island or Egyptian cotton, which have longer fibres.

The roughened surface layer of the roller was traditionally leather. In more recent times the preferred material is a laminate of fifteen or more layers of woven or knitted fabric sheets bonded together by polymer and then cut perpendicularly into strips in which the sheets are oriented perpendicular to the surface so that their edges form the surface. These strips are bonded side by side to form the roller covering. This material was sold under the trade name 'Garlock' by Garlock Inc of Palmyra, N.Y. It is now produced and sold under less distinctive trade names by Pirelli and Good Year.

In an attempt to increase yield/speed of operation compared to a roller gin, while maintaining high quality product, a proposal was made in U.S. Pat. No. 6,115,887 (Riter) for a linear gin system. In this a linear belt flight having an upper surface of roughened high friction material, typically the aforesaid material, was described as being guided upon rollers to move past a blade extending transversely across the upper surface in contact therewith, whereby seed would be stripped from the fibre as the fibre, which adhered to the upper surface was dragged below the blade, and later removed downstream of the blade via a suction type doffing chamber.

Back up pressure rollers were described as being mounted below the belt at positions corresponding to respective blades in order to keep the belt upper surface in contact with the respective blades.

Such a proposal is not believed to be workable and no practical embodiment is known to the present applicant. The type of material required for the belt upper run (as previously sold under the name Garlock as mentioned above) is not sufficiently flexible or resilient to be guided accurately as an endless belt in this way. Contact with the fixed blades could not be reliably achieved. Without contact the seed may not be stripped. However, high pressure contact results in frictional temperature increases which leads not only to rapid deterioration of the belt but more importantly a danger of ignition of the seed cotton so that the gin has to be shut down. Any damage to the belt would, furthermore, require a full replacement, which would be expensive. Therefore, operating and maintenance difficulties would preclude the adoption of this style of ginning apparatus.

An object of the invention is to provide a new and improved gin of simple, reliable and economical construction.

A further object of the invention is to provide a gin which has a fibre output of a quality equal to or higher than a roller gin, but at higher rates of yield and/or lower maintenance cost.

As already outlined above, U.S. Pat. No. 6,115,887 discloses ginning apparatus for separating cotton seed from fibre comprising a driven conveyor having a linear flight extending for linear movement in a forward direction of travel, said linear flight having an upper surface for receiving and transporting seed cotton, which upper surface is roughened so that cotton fibre will adhere to it, a blade extending transversely across said linear flight and having a lower surface in contact with said upper surface of said linear flight to define a pinch point therebetween so that adhesion of the cotton fibre to said flight upper surface pulls the fibre through the pinch point while simultaneously separating the fibre from the seed. An air doffing chamber is provided at a location downstream of the blade, extending transversely across said linear flight adjacent said upper surface for removal of the fibre from said upper surface.

A first aspect of the present invention is characterised in that the driven conveyor providing the linear flight comprises a plurality of spaced apart slats, each extending transversely across said linear flight and each having a respective upper layer of surface roughened material to define thereby said linear flight upper surface, in which respect said upper surface is discontinuous by virtue of transverse gaps between the respective slat upper layers.

Accordingly, a first aspect of the present invention, in contrast to the earlier proposal, does not employ a belt. The present invention employs a conveyor made up of a plurality of spaced apart slats. This results in numerous advantages, some of which are:

1. The slatted conveyor can be reliably, accurately, smoothly driven in an endless path, and guided upon a track in its upper run so as to keep the upper surface supported and level.
2. If the upper surface layer material is damaged, only a strip for covering a single slat or the relevant number of slats which are damaged needs to be replaced, instead of a whole belt. Replacement of the surface of one slat is far less costly and less difficult to achieve than a whole belt.
3. The size of the gaps between the slat upper surfaces can be selected so that seeds of the supplied picked cotton tend to sit across the top of these gaps and this facilitates the severance of seeds from the fibre by the blade.
4. The gaps between the slats allow for air flow upwards or downwards through the conveyor, facilitating fibre removal from the upper surface, by air blowing or suction, after severance of the seeds.

A further (second) aspect of the invention is ginning apparatus for separating cotton seed from fibre comprising a roughened surface for receiving and transporting seed cotton in a forward direction of travel and a blade extending transversely across said surface relative to said direction of travel, said blade having a lower surface in contact with said roughened surface to define a pinch point therebetween so that cotton fibre adhering to said roughened surface is pulled through the pinch point and the seed can be separated therefrom above the blade, characterised by provision of a mounting assembly mounting said blade, said mounting assembly including a fluid actuated piston arranged to resiliently bias the blade so that the lower surface of the blade remains in floating contact with said roughened surface.

Such a blade mounting assembly is not limited to use in a linear ginning apparatus employing a conveyor formed of plural spaced apart slats. This blade mounting assembly, which includes a fluid actuated piston for resiliently biaising the blade, could be used in any other known or yet to be devised gin.

The lower surface of the blade may have a rear region formed with a recess so that only a blade tip portion of its lower surface is in contact with said roughened surface.

A further (third) aspect of the invention is ginning apparatus for separating cotton seed from fibre comprising a roughened surface for receiving and transporting seed cotton in a forward direction of travel and a blade extending transversely across said surface relative to said direction of travel, said blade having a lower surface in contact with said roughened surface to define a pinch point therebetween so that cotton fibre adhering to said roughened surface is pulled through the pinch point and the seed can be separated therefrom above the blade, characterised by provision of a seed cotton feed assembly mounted upstream of the blade, said assembly comprising a housing into which seed cotton is supplied and having an outlet extending transversely of the direction of the travel of the roughened surface, a cylinder rotatably mounted inside the housing and having an axis extending transversely of the direction of travel of the roughened surface and a breaker blade mounted inside the housing and extending parallel to the cylinder axis, the cylinder having a plurality of radially projecting spikes distributed over its surface, the position of the cylinder relative to the breaker blade and the length and spacing of the spikes being selected to distribute seed cotton evenly and at a predetermined thickness across the roughened surface.

Such a feed assembly is not limited to use in a linear ginning apparatus employing a conveyor formed of plural spaced apart slats. This feed assembly, which includes a spiked roller co-operating with a fixed breaker blade, could be used in any other known or yet to be devised gin.

The position of the cylinder relative to the breaker blade and the length and spacing of the spikes may be selected to distribute seed cotton at a thickness less than twice the size of the cotton seed so that only a single seed is fed onto the roughened surface at any transverse position.

The radially projecting spikes are preferably distributed over the surface of the cylinder in a plurality of circumferentially spaced longitudinally arranged rows, alternate rows being displaced longitudinally (axially) of the cylinder relative to adjacent rows.

The various aspects of the present invention will be described further, by way of example, with reference to the accompanying drawings, in which:

FIG. 7 is a perspective view of a single slat of the same conveyor in isolation;

FIGS. 8 to 10 are corresponding plan, inverted side and inverted end views of the same individual slat;

The drawings illustrate a practical embodiment of cotton ginning apparatus which incorporates all aspects of the present invention.

Figure 1:
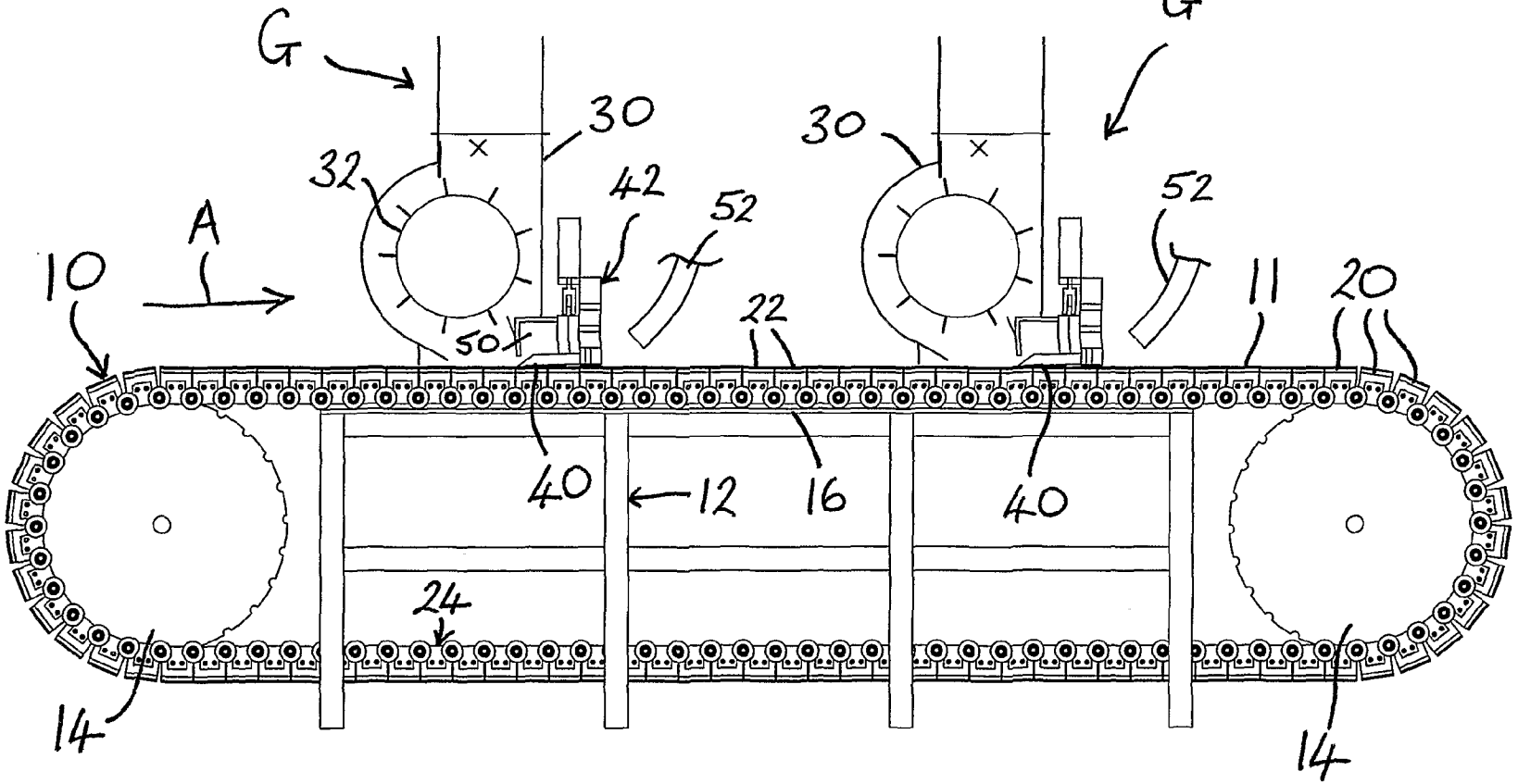
FIG. 1 is a schematic side elevation of a practical embodiment of apparatus in accordance with the invention.
Figure 3:
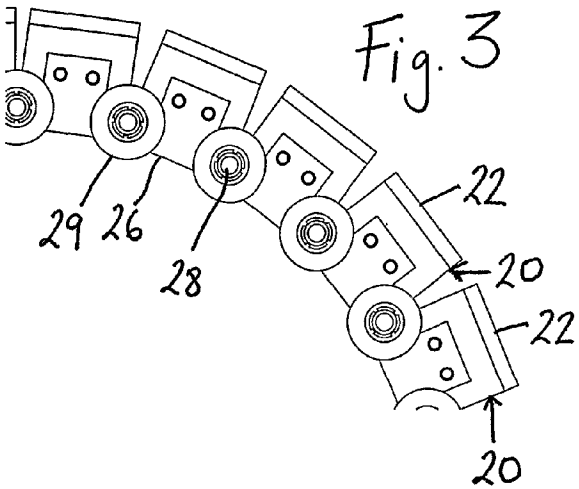
FIG. 3 is a further enlarged side view of a small portion of the conveyor.

Referring firstly to FIG. 1, this embodiment comprises a driven endless conveyor, designated generally by reference numeral 10, which is supported upon a frame 12 and guided in an endless loop around respective concentric pairs of sprockets 14. One of these sprocket pairs is driven, typically by an electric motor (not shown), while the other sprocket pair is an idler. Thus the upper section 11 of the endless conveyor 10 constitutes a linear flight extending for linear movement in a forward direction of travel, indicated by arrow A in FIG. 1. The conveyor 10 comprises a plurality of spaced apart slats 20, each extending transversely relative to the direction of travel A and substantially parallel to each other. Each slat 20 has a respective upper layer 22 of surface roughened material, typically of the type of material described in the introduction above as being previously sold under the Garlock trade name. Thus as the slatted conveyor passes along the upper section of its endless path, the respective slat upper layers 22 define an upper surface for receiving and transporting seed cotton. The adjacent slat upper layers 22 have transverse gaps between them, corresponding to the slats 20 on which they are supported, so the upper surface of the linear flight onto which the seed cotton is fed is discontinuous.

Two ginning stations, where seed cotton is fed to the conveyor 10 and the seed is stripped from the lint (fibre) are shown in FIG. 1 and are designated generally by reference letter G. It will be understood that any suitable number of such stations can be provided in the apparatus in accordance with the invention, and two are illustrated here only by way of example. At each station G seed cotton is supplied to the conveyor 10 from a feed assembly housing 30, which will be described in greater detail below. Also at each station G a blade 40 extends transversely across the linear flight of the conveyor 10. A lower surface of the blade 40 is held in contact with the upper surface of the conveyor 10 to define a pinch point there between so that adhesion of the cotton fibre to the roughened surface layer of the slats 20 pulls the fibre through the pinch point while the blade simultaneously separates the seed from the fibre. An air flow chamber 50 is arranged above the blade 40. An air blower (not shown) directs air through this chamber 50, transversely of the direction of travel A of the conveyor 10 so that seed separated from the fibre at the pinch point is removed transversely of the direction of travel of the linear flight and collected in a receptacle (not shown) at one end of the chamber 50.

Figure 5:
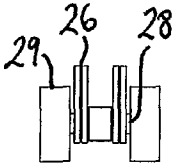
FIG. 5 is an end view of a single pair of links and rollers of the conveyor to a similar enlarged scale to FIGS. 3 and 4.
Figure 4:
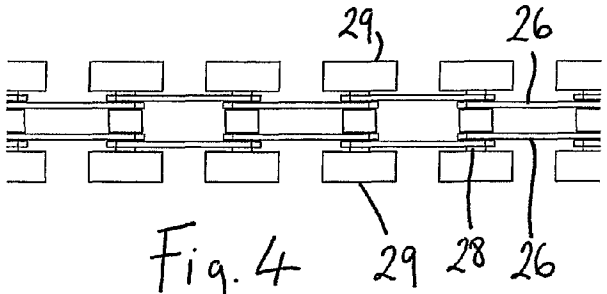
FIG. 4 is a view of similar enlarged scale to FIG. 3 showing the links and rollers of the conveyor from the underside.
Figure 2:
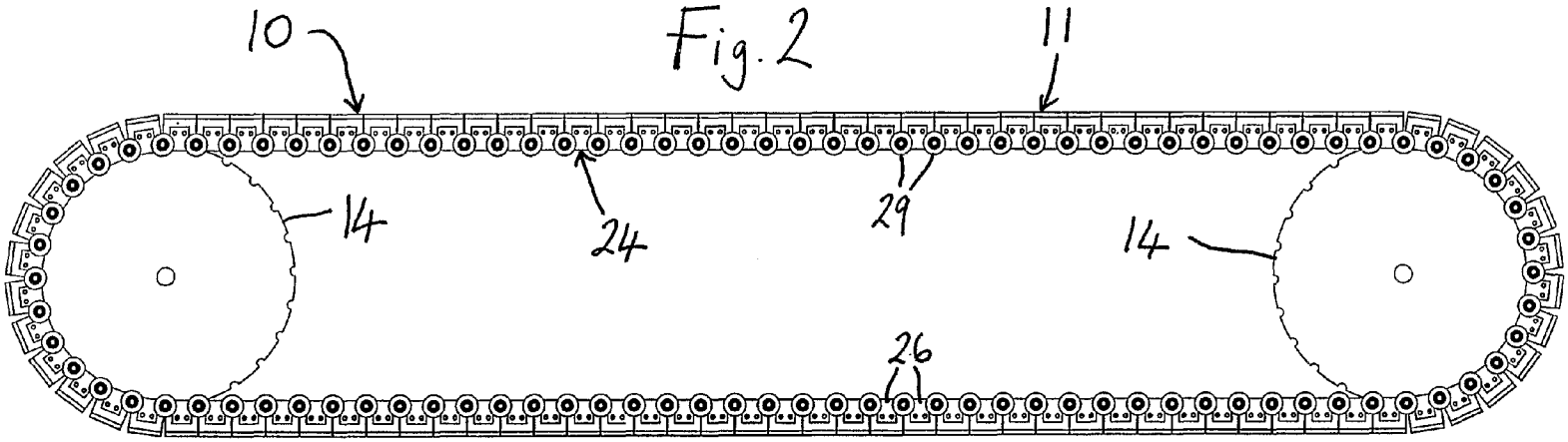
FIG. 2 is an enlarged side view of the conveyor of the apparatus of FIG. 1 in isolation.
Figure 6:
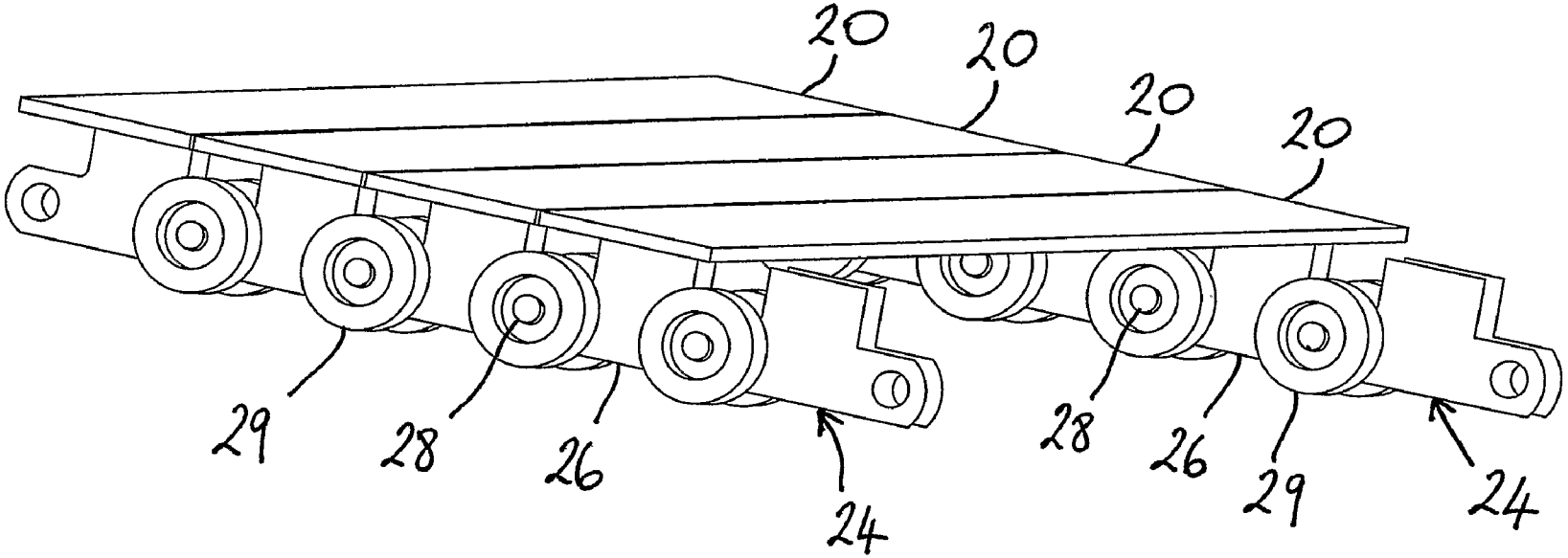
FIG. 6 is an enlarged perspective view of a portion of the same conveyor as shown in FIGS. 1 to 5.

FIGS. 2 to 10 show the structure of the conveyor 10 and its individual parts in greater detail. As best shown in FIG. 6, the side by side slats 20 are mounted between a pair of chains 24. Each chain 24 is formed of a series of paired links 26 pivotally connected to each other by respective pins 28, and rollers 29 are fitted to the ends of these pins 28, as shown in FIGS. 4 and 5.

The structure of each individual slat 20 is shown in FIGS. 7 to 10. The basic slat 20 is suitably made of steel with the upper surface layer 22 (not shown in FIGS. 6 to 10) attached by fasteners (bolts) extending through the steel base, fixing holes for which are evident in FIGS. 7 to 10. The surface layer 22 consists of a strip of the previously discussed roughened surface material of a size to match the size of the steel base. Suitable dimensions for the slat are 3 inches×24 inches (approximately 25×60 cm), and a thickness of ¾ inches (approximately 1.9 cm) of which the steel base may be about ¼ inches (0.64 cm) and the upper layer 22 the remainder. These dimensions are merely given by way of example and could be varied in other embodiments of the invention. Each slat 20 has a pair of mounting blocks 21, one near each end. For mounting to the chains 24, these blocks 21 are inserted between the respective paired links 26 and bolted in position there to arrive at the structure shown in FIG. 6 with a respective slat 20 extending between each consecutive corresponding link pair 26 of the respective chains 24 at each side of the conveyor.

Each chain 24 is guided by means of the rollers 29 around a respective sprocket 14 at each end of the linear upper flight. Thus as mentioned previously, there is a concentric pair of sprockets 14 at each end of the conveyor and one of these pairs is driven, thereby driving the conveyor 10. Such sprockets may have a diameter of 24 inches (approximately 60 cm) and operate at a speed of 100 rpm. Again these figures are provided only by way of example and may vary in other embodiments of the invention.

Figure 12:
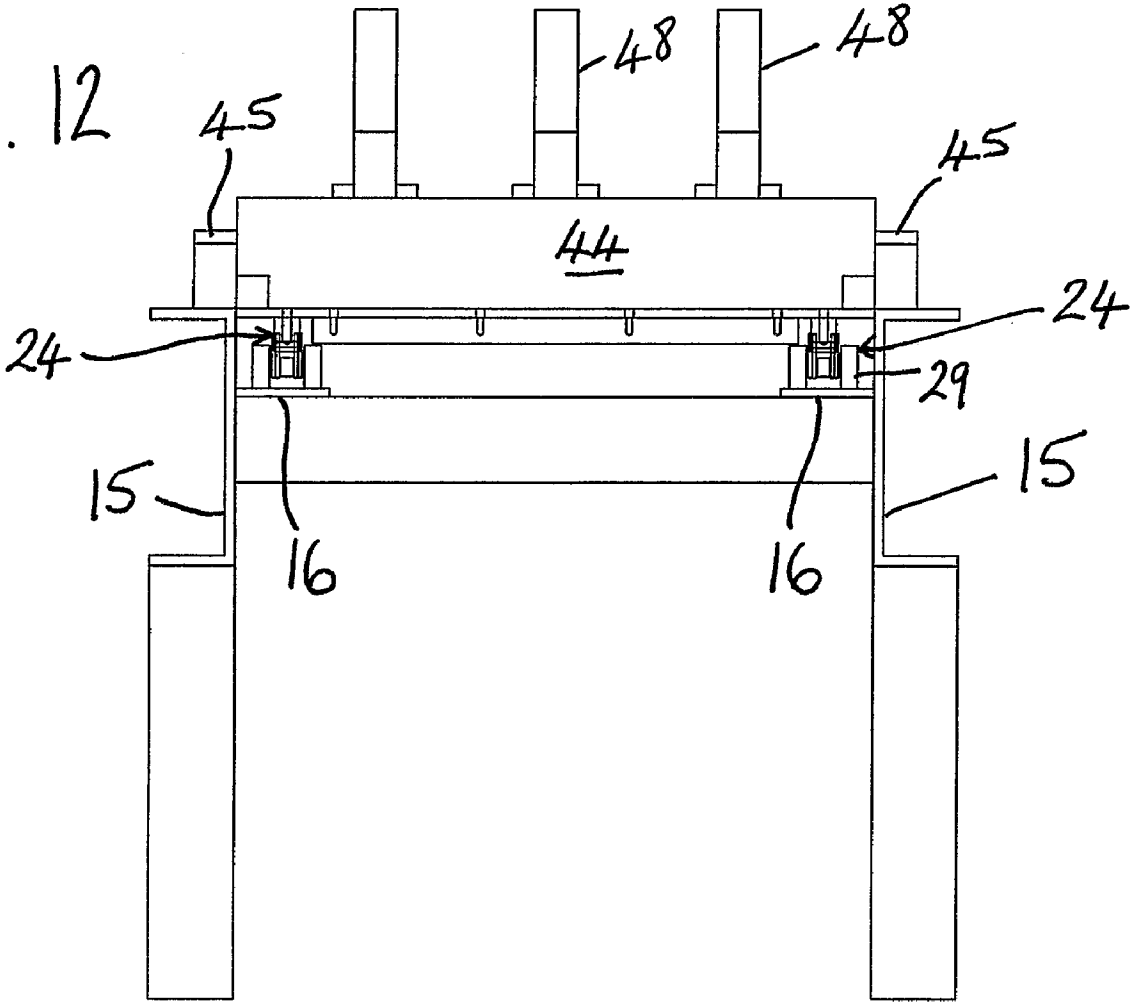
FIG. 12 is an end view, from the rear or downstream end, of one of the blade assemblies and supporting tracks of FIG. 11.

In its upper flight the conveyor 10, specifically the rollers 29 of each chain 24 are supported and guided along respective substantially horizontal tracks 16, best shown in FIGS. 1 and 12, which extend inwardly from main side beams 15 of the supporting frame 12. Such support ensures that the upper surface of the conveyor 10, itself formed of successive rigid slats 20, is, in its upper flight, held correctly and consistently level and that the conveyor is able to travel at the high speeds required without tracking problems. Speeds of 200 m/min may typically be achieved.

The gaps between the adjacent slats of the conveyor 10 are set at between 2.5 mm and 7.5 mm. A preferred range is between ⅛ and ¼ inches (3.1 and 6.4 mm), and about ⅛ inch (3.1 mm) is probably preferred. The size of the gap is preferably matched to be slightly less than the maximum dimension of the seed of the relevant variety of cotton which is to be processed by the machine. When the seed cotton is feed onto the surface during operation of the machine, the seeds tend to sit across the tops of the gaps, and be tossed up and more effectively cut apart from the fibre when the blade 40 is encountered.

Figure 11:
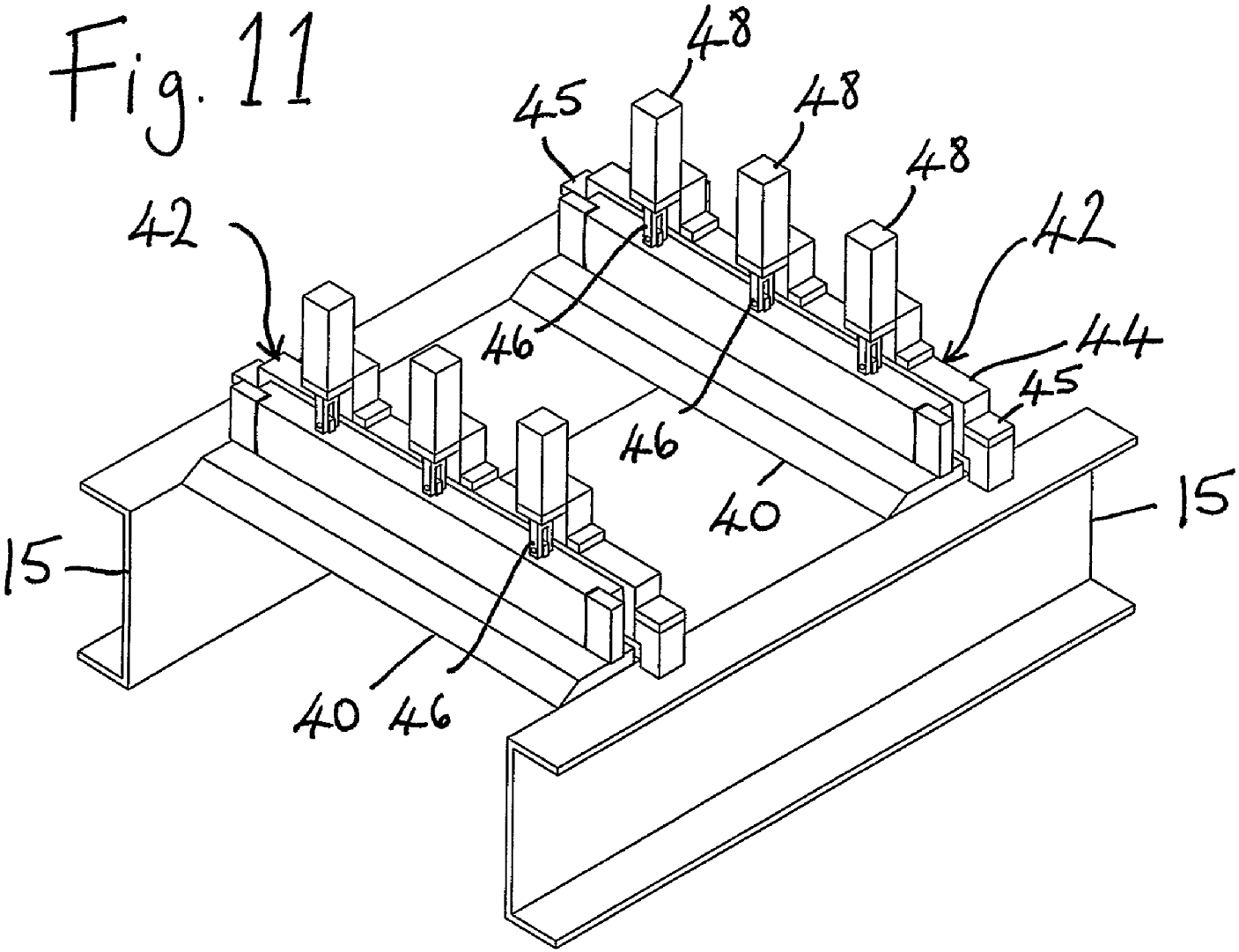
FIG. 11 is a perspective view, to an enlarged scale compared to FIG. 1, of two blade assemblies and the supporting tracks of the apparatus of FIG. 1.
Figure 13:
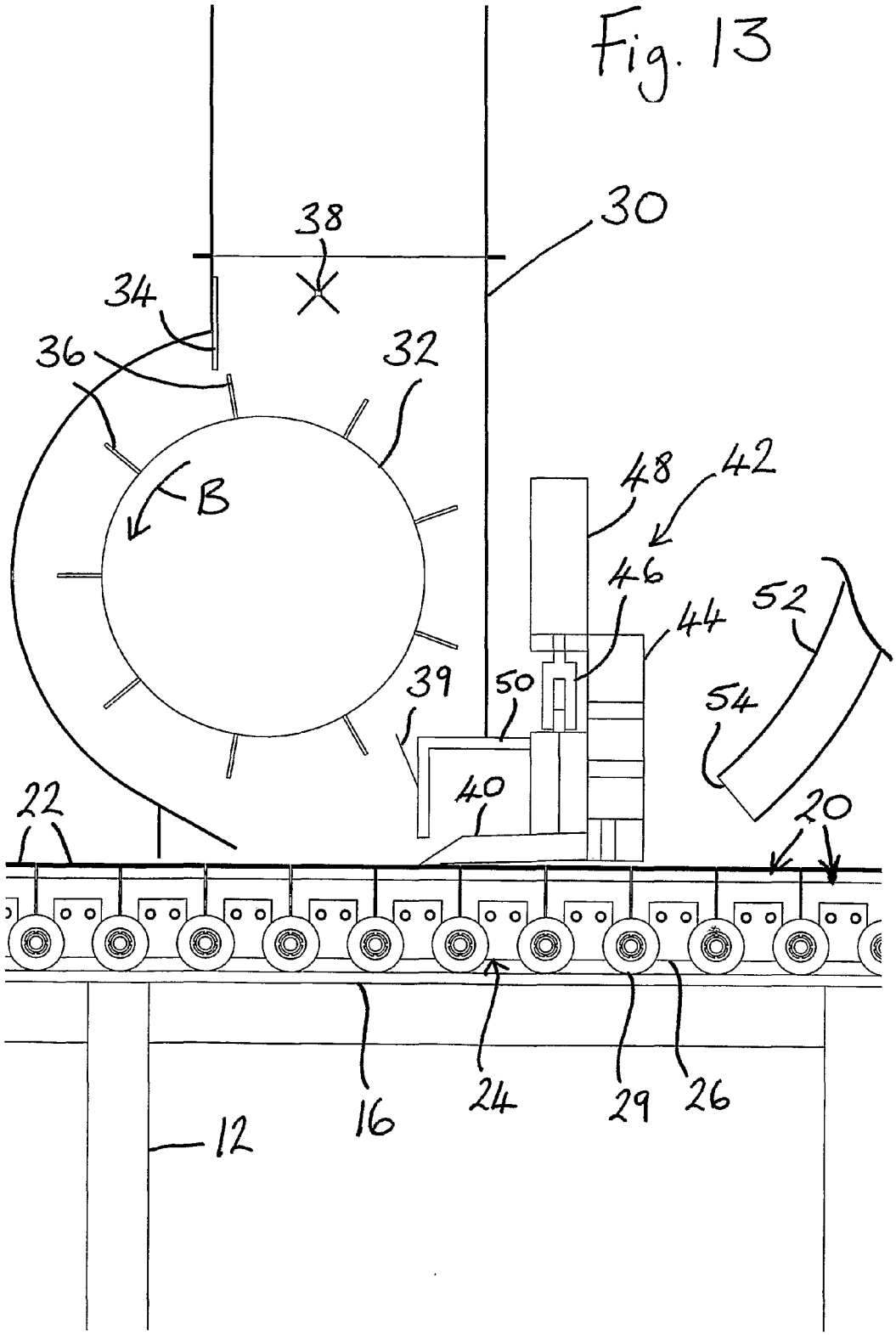
FIG. 13 is a fragmentary schematic side view showing, to an enlarged scale, a portion of the conveyor and one of the blade assemblies and associated cotton feed assemblies of the apparatus of FIG. 1.

FIGS. 11, 12 and 13 illustrate in greater detail the mounting of the blade 40 of each ginning station G. The blade 40 is typically made of steel. Its mounting is achieved at each station G by a blade mounting assembly, designated generally by reference numeral 42, which extends transversely across the linear flight of the upper run of the conveyor 10. The blade 40 is attached by way of a holder structure 44, to the pistons 46 of three air cylinders 48, which are synchronously operated to apply a predetermined even pressure to the blade 40 so that a lower surface of the blade 40 makes contact with the upper surface layer 22 of the slats 20. Although three cylinders 48 are shown here, any number suitable to particular machine requirements may be provided in other embodiments. Such biasing action of the air cylinders 48 allows the blade 40 to remain in 'floating' contact with the conveyor surface, in that a rigid mounting of the blade, forcing it with some pressure into contact against the surface, as in previously known ginning apparatus, is avoided. This reduces frictional wear on the belt surface, and reduces heating of the conveyor and of the cotton fed thereto as occurs as a result of the friction between blade and surface. Moreover, it reduces the possibility of gaps arising between the blade and the surface owing to slight unevenness in the roughened surface, and thereby leads to more reliable stripping of fibre and higher purity of product.

Laterally projecting end portions 45 of the blade holder structure 44 extend above and rest upon the main side beams 15 of the supporting framework 12 at each side of the conveyor upper run, as best shown in FIGS. 11 and 12. The upper surface layer 22 of the slats 20 is gradually worn away by contact with the blade or blades 40 and then has to be replaced. The distance at which the blade holder structure 44 is held above the conveyer surface by the aforesaid mounting arrangement and the maximum permissible extension of the pistons 46 from the air cylinders 48 is such that the blade 40 will no longer be able to contact the conveyor upper surface when the surface layer 22 has been worn down to its minimum workable thickness, which may be about 2 mm. This is a safety measure to prevent the possibility of contact between the iron blade 40 and the steel slat base which could result in a fire hazard.

As best seen in FIG. 13, the blade 40 is mounted by the holder structure 44 at an angle relative to the conveyor upper surface so that only a blade tip portion of its lower surface is in contact with said upper surface. The angle relative to the conveyor surface may be slight, for example in the region of 2 degrees. This enhances the above mentioned advantages of reducing frictional wear and heating.

Also as shown in FIG. 13, the lower surface of the blade 40 has a rear region (in the direction away from the tip) formed with a recess. Such a recess may be less than 1 mm in depth. Again this means that only a blade tip portion of its lower surface is in contact with the upper surface of the conveyor and enhances the above mentioned advantages of reducing frictional wear and heating.

The feed assembly housing 30 which is mounted just upstream of the blade assembly 42 in the direction of travel A of the conveyor upper run is illustrated schematically in FIG. 13. The housing 30, into which seed cotton is supplied has an outlet extending transversely of the direction of the travel of the conveyor 10. A cylinder 32, which has its axis extending transversely of the direction of travel A of the conveyor, is rotatably mounted inside the housing 30. A breaker blade 34 is also mounted inside the housing 30. This blade 34 extends parallel to the axis of the cylinder 32 and is shown here projecting downwards towards the cylinder 32.

Figure 14:
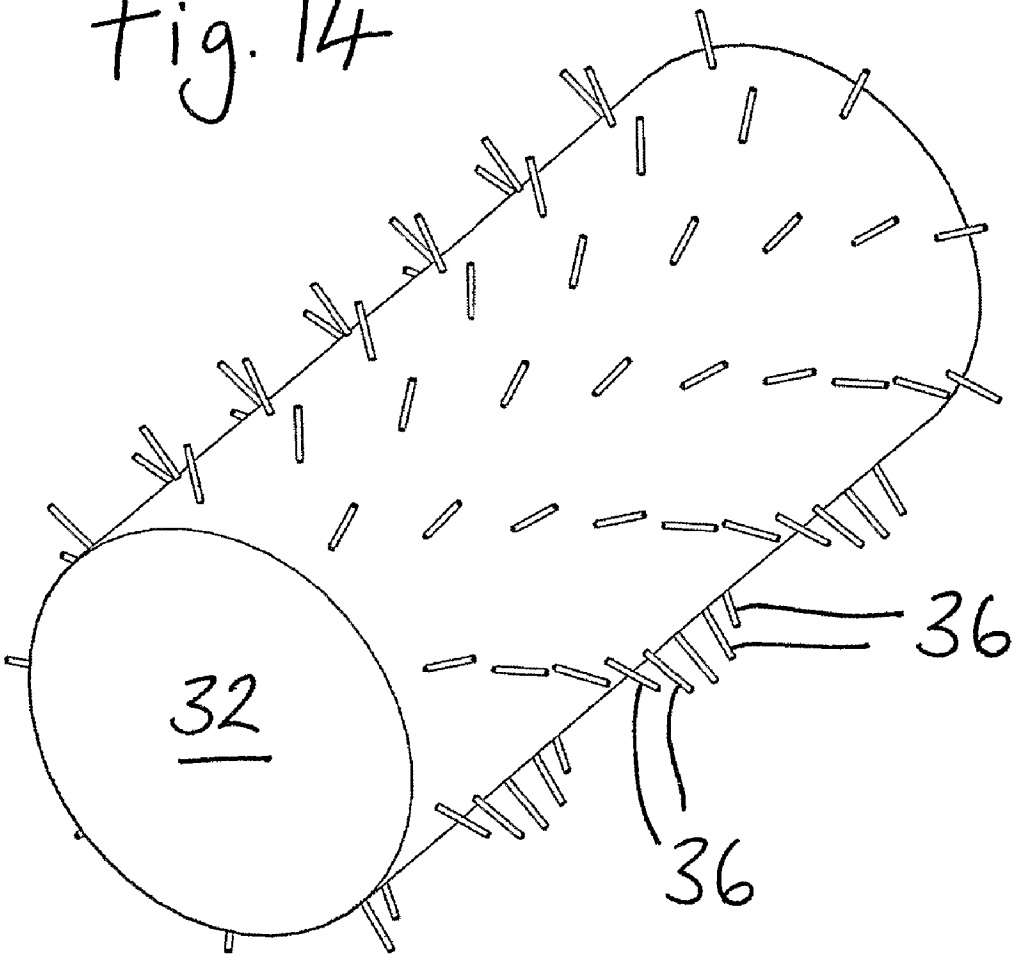
FIG. 14 is a perspective view of the spiked cylinder of FIG. 13 in isolation.

The cylinder 32 has a plurality of radially projecting spikes 36 distributed over its surface. These spikes 36 are arranged in a plurality of circumferentially spaced longitudinally arranged rows, alternate rows being displaced longitudinally (axially of the cylinder 32) relative to adjacent rows, as shown in FIG. 14.

As the cylinder 32 rotates, there is a gap between the ends of the spikes 36, and the breaker blade 34. This gap is preferably about ¼ inches (0.64 cm), but is selected to suit the variety of cotton being processed. The position of the cylinder 32 relative to the breaker blade 34 and the length and spacing of the spikes 36 are selected to distribute seed cotton evenly and at a predetermined thickness across the linear flight, i.e. the upper surface of the conveyor 10. Ideally these parameters are selected to distribute seed cotton at a thickness less than twice the size of the cotton seed so that only a single seed is fed onto the linear flight at any transverse position.

A conventional feed roller 38 is mounted in the housing 30 above the cylinder 32. Thus, in operation, as seed cotton is fed in to the top of the housing 30, it is generally distributed by the feed roller 38, then effectively combed and teased by the spikes 36 of the cylinder 32 as it rotates in the direction indicated by arrow B in FIGS. 13 and 15, and only allowed through the gap between the spikes 36 and the blade 34 to be fed onto the conveyor surface in a layer which includes only one seed at a time.

A deflector strip 39 projects obliquely upwards from a wall of the air flow chamber 50 towards the cylinder 32 to prevent any seed cotton carried around by the cylinder 32 as it rotates from falling back towards the conveyor 10.

Figure 15:
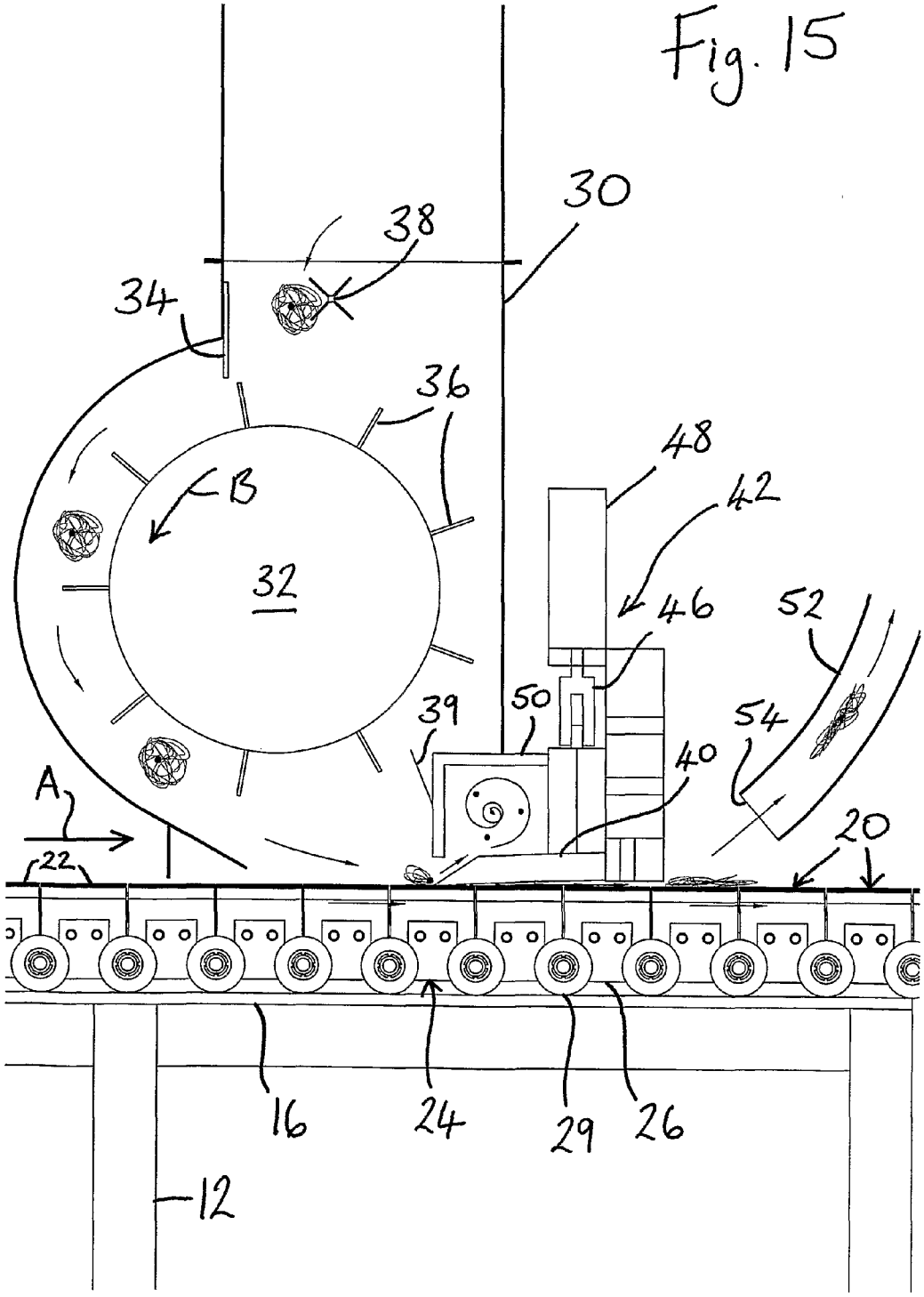
FIG. 15 is a view similar to FIG. 13 illustrating the ginning station in operation.

Upon the conveyor surface, and referring now to FIG. 15 and operation of the machine, the seeds tend to lodge momentarily across the top of the gaps between the slats 20 of the conveyor. The fibre adheres to the surface layer 22 of the slats. The seeds then encounter the blade 40 and are severed, tossed up into the chamber 50 and blown to one side of the conveyor for collection. The fibre passes below the blade 40, which is in the above described 'floating' contact with the conveyor surface. An air suction device 52 with an elongate transversely extending inlet 54 is mounted above the conveyor 10 immediately downstream of the blade 40 in the direction of travel of the conveyor upper run. This suction device 52 draws air upwards between adjacent slats 20 of the conveyor in order to remove separated fibre from said upper surface, as shown diagrammatically in FIG. 15.

The foregoing is illustrative and not limitative of the scope of the invention and its various aspects. Variations are possible in other embodiments, not only in respect of the features and dimensions where the possibility of variation has already been mentioned, but also in any other detail of construction not specified in the relevant independent claims appended hereto.

Throughout the description and claims of this specification, the singular encompasses the plural unless the context otherwise requires. In particular, where the indefinite article is used, the specification is to be understood as contemplating plurality as well as singularity, unless the context requires otherwise.

Features described in conjunction with a particular aspect, embodiment or example of the invention are to be understood to be applicable to any other aspect, embodiment or example described herein unless incompatible therewith.

The invention claimed is:

1. Ginning apparatus for separating cotton seed from fiber comprising: a driven conveyor having a linear flight extending for linear movement in a forward direction of travel, said linear flight having an upper surface for receiving and transporting seed cotton, which upper surface is roughened so that cotton fiber will adhere to it, and a blade extending transversely across said linear flight and having a lower surface in contact with said upper surface of said linear flight to define a pinch point therebetween so that adhesion of the cotton fiber to said flight upper surface pulls the fiber through the pinch point while simultaneously separating the fiber from the seed, characterized in that the driven conveyor providing the linear flight comprises a plurality of spaced apart slats, each extending transversely across said linear flight and each having a respective upper layer of surface roughened material to define thereby said linear flight upper surface, in which respect said upper surface is discontinuous by virtue of transverse gaps of between 2.5 mm and 7.5 mm between the respective slat upper layers.

2. Apparatus according to claim 1 wherein an air flow chamber is arranged above the blade so that seed separated from the fiber at the pinch point can be removed transversely of the direction of travel of the linear flight via said chamber.

3. Apparatus according to claim 1 wherein the driven conveyor further comprises a pair of substantially parallel endless chains, each formed of plural chain links, between which the respective slats are mounted.

4. Apparatus according to claim 3 further comprising respective guide tracks at each side of the linear flight, the chains having rollers mounted thereto whereby the chains are guided along the respective guide tracks.

5. Apparatus according to claim 3 further comprising respective pairs of sprockets at each end of the linear flight, the chains having rollers mounted thereto whereby the chains are guided, each in an endless loop, around the respective pairs of sockets.

6. Apparatus according to claim 1 wherein the blade is mounted at an angle relative to said linear flight upper surface so that only a blade tip portion of its lower surface is in contact with said upper surface.

7. Apparatus according to claim 1 wherein the lower surface of the blade has a rear region formed with a recess so that only a blade tip portion of its lower surface is in contact with said linear flight upper surface.

8. Ginning apparatus for separating cotton seed from fiber comprising: a driven conveyor having a linear flight extending for linear movement in a forward direction of travel, said linear flight having an upper surface for receiving and transporting seed cotton, which upper surface is roughened so that cotton fiber will adhere to it, and a blade extending transversely across said linear flight and having a lower surface in contact with said upper surface of said linear flight to define a pinch point therebetween so that adhesion of while simultaneously separating the fiber from the seed, characterized in that the driven conveyor providing the linear flight comprises a plurality of spaced apart slats each extending transversely across said linear flight and each having a respective upper layer of surface roughened material to define thereby said linear flight upper surface, in which respect said upper surface is discontinuous by virtue of transverse gaps between the respective slat upper layers; and further comprising a blade mounting assembly including a fluid actuated piston arranged to resiliently bias said blade so that the lower surface of said blade remains in floating contact with said upper surface of said linear flight.

9. Apparatus according to claim 1 further comprising at least one air suction device mounted above the linear flight and downstream of the blade in the direction of travel of the linear flight and so arranged to draw air upwards between adjacent slats of the conveyor and through the gaps in the linear flight upper surface in order to remove separated fiber from said upper surface.

10. Apparatus according to claim 1 further comprising a seed cotton feed assembly mounted above the linear flight and upstream of the blade, said assembly comprising a housing, into which seed cotton is supplied and having an outlet extending transversely of the direction of the travel of the linear flight, a cylinder rotatably mounted inside the housing and having an axis extending transversely of the direction of travel of the linear flight and a breaker blade mounted inside the housing and extending parallel to the cylinder axis, the cylinder having a plurality of radially projecting spikes distributed over its surface, the position of the cylinder relative to the breaker blade and the length and spacing of the spikes being selected to distribute seed cotton evenly and at a predetermined thickness across the linear flight.

11. Apparatus according to claim 10 wherein the position of the cylinder relative to the breaker blade and the length and spacing of the spikes are selected to distribute seed cotton at a thickness less than twice the size of the cotton seed so that only a single seed is fed onto the linear flight at any transverse position.

12. Apparatus according to claim 10 wherein the radially projecting spikes are distributed over the surface of the cylinder in a plurality of circumferentially spaced longitudinally arranged rows, alternate rows being displaced longitudinally (axially of the cylinder) relative to adjacent rows.

13. Ginning apparatus for separating cotton seed from fiber comprising a roughened surface for receiving and transporting seed cotton in a forward direction of travel and a blade extending transversely across said surface relative to said direction of travel, said blade having a lower surface in contact with said roughened surface to define a pinch point therebetween so that cotton fiber adhering to said roughened surface is pulled through the pinch point and the seed can be separated therefrom above the blade, characterized by provision of a mounting assembly mounting said blade, said mounting assembly including a fluid actuated piston arranged to resiliently bias the blade so that the lower surface of the blade remains in floating contact with said roughened surface.

14. Apparatus according to claim 13 wherein the lower surface of the blade has a rear region formed with a recess so that only a blade tip portion of its lower surface is in contact with said roughened surface.

15. Apparatus according to claim 13 wherein the blade is mounted at an angle relative to said roughened surface so that only a blade tip portion of its lower surface is in contact with said surface.

* * * * *